United States Patent [19]

Münnich et al.

[11] Patent Number: 4,492,328

[45] Date of Patent: Jan. 8, 1985

[54] AIR-FLOW EQUIPPED TURNING BAR FOR WEB MATERIAL

[75] Inventors: Wilhelm Münnich; Manfred Batke, both of Augsburg, Fed. Rep. of Germany

[73] Assignee: M.A.N.-Roland Druckmaschinen Aktiengesellschaft, Offenbach am Main, Fed. Rep. of Germany

[21] Appl. No.: 510,309

[22] Filed: Jul. 1, 1983

[30] Foreign Application Priority Data

Jul. 10, 1982 [DE] Fed. Rep. of Germany ..... 3225922

[51] Int. Cl.[3] ..... B65H 23/32

[52] U.S. Cl. ..... 226/197

[58] Field of Search ..... 226/97, 7, 196, 197, 226/198, 199, 95; 34/10, 29, 156; 242/76

[56] References Cited

U.S. PATENT DOCUMENTS

| | | | |
|---|---|---|---|
| 1,630,713 | 5/1927 | Meyer | 226/97 |
| 1,650,927 | 11/1927 | Barber | 226/97 X |
| 2,852,253 | 9/1958 | Pouliart et al. | 226/95 |
| 3,057,079 | 10/1962 | Schmidt | 226/97 X |
| 3,181,174 | 4/1965 | Griffioen et al. | 226/76 X |
| 3,266,690 | 8/1966 | Goettsch | 226/95 |
| 3,599,851 | 8/1971 | Hedlund et al. | 226/197 X |
| 3,744,693 | 7/1973 | Greiner | 226/97 |
| 3,962,799 | 6/1976 | Lapointe et al. | 34/156 X |
| 4,043,495 | 8/1977 | Sander | 226/97 X |
| 4,406,388 | 9/1983 | Takashi et al. | 226/7 |

OTHER PUBLICATIONS

Oskar Frey, Polygraph-Verlag, 1979, p. 56.

*Primary Examiner*—Harvey C. Hornsby
*Assistant Examiner*—Scott J. Haugland
*Attorney, Agent, or Firm*—Frishauf, Holtz, Goodman & Woodward

[57] ABSTRACT

To provide for a tight seal upon selectively closing air exit openings from a compressed air-supplied tubular turning bar, a preferably endless tape or ribbon is moved within the bar, the ribbon having a slit of about half its length, for selectively positioning a solid portion or the slit opposite the air exit openings. The tape or ribbon can be positioned by a follower to which it is clamped, located on a rotatable spindle; or coupled to externally positionable deflection rollers. The excess air pressure within the interior of the tube seals the tape against the portions of the inner wall of the tube in the regions where the slit is absent.

15 Claims, 6 Drawing Figures

AIR-FLOW EQUIPPED TURNING BAR FOR WEB MATERIAL

The present invention relates to a turning rod or turning bar which is hollow and has air at excess air pressure, for example compressed air, applied thereto, the turning bar being provided to change the direction of a path, for example a freshly printed paper web derived from a rotary printing machine. Turning bars of this type are formed with air exit openings which, to permit passage of webs of varying widths thereover, should be selectively closeable, so as to prevent escape of air from holes which are not facing a portion of the web.

BACKGROUND

An air-equipped turning rod is described of page 56 of the textbook entitled "Technology, Systems, Machines" ("Techniken, Systeme, Machines") by Oskar Frey, Polygraph-Verlag, 1979, in which an external tube receives compressed air over a flexible hose, the tube being formed with air exit holes therethrough. Depending on the width of the web which is to be turned, a second, interior tube can be twisted or longitudinally shifted in order to close off those holes which are not needed to float the web to be turned about the turning bar.

It has been found that all such arrangements cause problems of sealing, that is, have problems in connection with undesired, unintended escape of air from various joints and the like which, frequently, are caused by manufacturing tolerances.

THE INVENTION

It is an object to provide an air-flow equipped turning rod in which the width of air escape zones can be readily controlled, and which is not subject to sealing problems upon change of the width of the region of air emission.

Briefly, a tubular turning rod is provided formed with a row of air exit openings or holes therein. Compressed air is supplied to the interior of the tube. In accordance with a feature of the invention, a flexible ribbon or tape, having a longitudinal slit therein, is positioned within the tube, the position of the slit being adjustable with respect to the openings in the tube. Adjustment mechanisms can be provided to be externally controllable, either manually or automatically, for example by a servo motor, to slide the ribbon or tape back-and-forth, so that the slit covers more or fewer of the holes in the turning rod tube, in accordance with desired uncovered and covered holes, respectively. By providing a flexible tape or ribbon, air pressure above atmospheric, i.e., overpressure within the tube will press the ribbon against the inner wall of the tube, so that an effective seal of those portions of the ribbon against the openings are provided, which are remote from the slit.

In accordance with a preferred feature of the invention, the ribbon or tape is an endless band or tape, looped about two pulleys positioned in a holding assembly located transversely of the tube interiorly thereof. Longitudinal adjustment of the tape or ribbon can be effected by coupling a portion thereof to a threaded spindle or by passing a portion thereof or a motion-transmitting ribbon over a guide pulley which may have engagement pins fitting into similarly formed notches, and adjustable by externally accessible knobs, motors, or the like.

DRAWINGS

Figure 1:
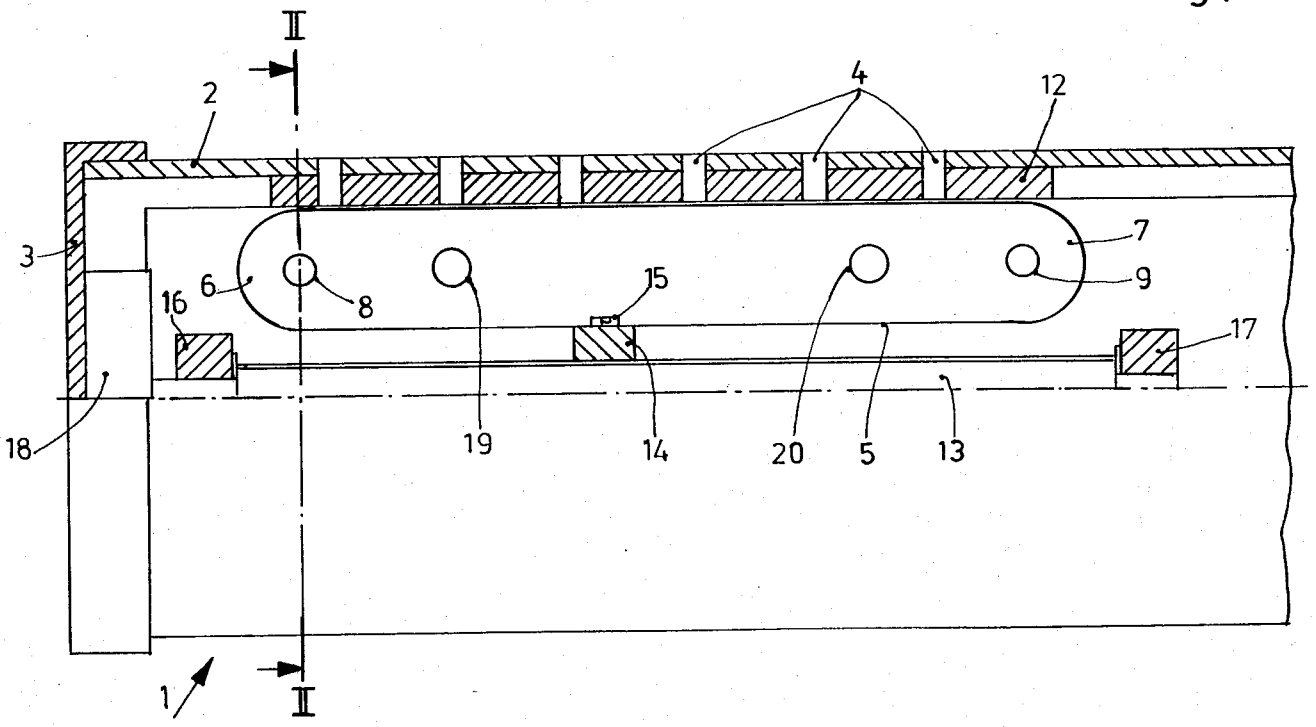
FIG. 1 is a fragmentary axial section through a portion of a hollow turning bar.

A portion of an air-equipped turning bar 1, namely the left end portion, is shown in FIG. 1, in which the upper half is shown in sections. The turning bar 1 is formed by a tube or tubular member 2, closed off at one end, as shown by a cap 3. Compressed air is supplied to the interior of the tube 2 by suitable compressed-air holes, not shown, for example being connected to a cap at the right side (not shown) of the tube. The tube is formed throughout at least a portion of its length with air exit openings 4, preferably arranged in a row.

A tape 5 (see FIG. 3) in which a slip 90 is cut extends axially within the interior of the tube 5. Preferably, tape 5 is a flexible endless ribbon which is made of a material resistant to toluol. Tape 5 is guided over end rollers 6, 7, of which only the outer circumference is visible in FIG. 1. The end rollers 6, 7 are axially retained on a bolt 8, 9. Bolts 8, 9 position the rollers 6, 7 at predetermined locations between a pair of parallel side plates 10, 11 (see FIG. 2). The side plates 10, 11, forming transverse elements positioned within the tube 2, extend diametrically through the entire tube 2 and are closed off at the top and bottom by a guide track or plate 12, 12', respectively.

For simplicity, the portions below the center line in FIG. 2 have been given the same reference numerals as those above the center line, with prime notation. They are identical or mirror-image identical to those above the center line or central plane through the tube 2.

Figure 2:
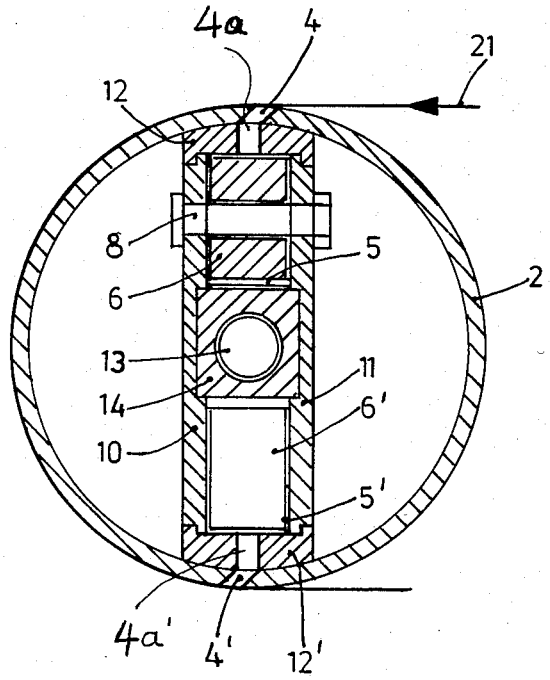
FIG. 2 is a cross section along lines II—II of FIG. 1.

The tracks or rails or plates 12, 12' are bowed at the side opposite each other, as seen in FIG. 2, to match the curvature of the tube 2. They are so arranged that they fit snugly against the inner wall of the tube 2. Holes **4*a* in the plates or rails 12, 12' are positioned to match the holes 4, 4' in the tube 2. The holes 4, 4' are preferably slanted, as seen in FIG. 2**, and are located along the circumference in two diametrically positioned rows.

Figure 3:
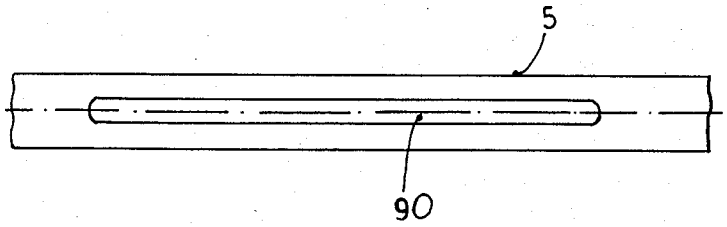
FIG. 3 is a fragmentary top view of the tape or ribbon used in the embodiment of FIG. 1.

The tapes or ribbons 5, 5' guided about the respective deflection rollers 6, 7 and 6', 7', respectively, can be positioned to cover those holes 4, **4*a*, 4', 4*a'* through which compressed air is not intended to be released. Due to the excess air pressure within the interior of the tube, the tapes 5, 5' will snugly engage against the guide rails or plates 12, 12' and thus, automatically, prevent escape of air from those holes 4, 4' which are covered by the solid portion of the tube 5. The tape 5 is best seen in FIG. 3, being formed with a longitudinal slit 90. The length of the slit 90 is, preferably, about half as long as the length of the tape 5**.

The tape 5 is positioned with the slit 90 covering more or fewer ones of the holes 4, 4' by connecting the tape 5 to a follower 14, for example by a screw 15, which follower is seated on a spindle 13. The spindle 13, which is threaded, can be rotated by a suitable coupling (not shown) to an externally accessible adjustment knob, a servo motor or the like. The spindle 13 is retained in end bearing blocks 16, 17 secured within tube 2, for example by transversely extending support elements similar to the plates 12 and the side walls 10, 11, or the like. A motor drive for the spindle preferably should have a reversible motor. The lower run of the endless tape 5 is secured to the follower block 14, as best seen in FIG. 1.

Operation: The slit 90-see FIG. 3-is about half as long as the entire length of the endless tape 5. Thus, tape 5 may permit coverage of all of the air exit openings 5 if the follower 14 is moved in the leftmost position, that is, close to the deflection roller 6. Upon suitable drive of spindle 13 to move the follower to the extreme right position, that is, close to the deflection roller 7, the slit 90 will be opposite all of the air exit openings 4. Suitable intermediate positions, thus, can uncover or leave free any number of air exit openings or holes 4.

To insure that uniform over pressure, that is pressure above atmospheric is also applied within the tape 5, the side walls 10, 11 are formed with a suitable number of air communication holes 19, 20-see FIG. 1.

As best seen in FIG. 2, two rows of air exit openings 4, 4' are provided, and the arrangement shown in section in FIG. 1 is located, in mirror image relation, in the lower portion of the turning bar 1. Thus, a web 21, which is to be turned or deflected by the turning bar 1, will be subjected to compressed air at the position of first meeting the bar 1 and leaving it. This improves guidance of the web over the bar and prevents smearing of freshly printed ink or other material applied to the web.

The arrangement shown in FIG. 1, only at the left side of the turning bar 1, can be duplicated at the right side, again by placing a similar arrangement thereat, positioned in mirror-image relationship thereto.

Figure 4:
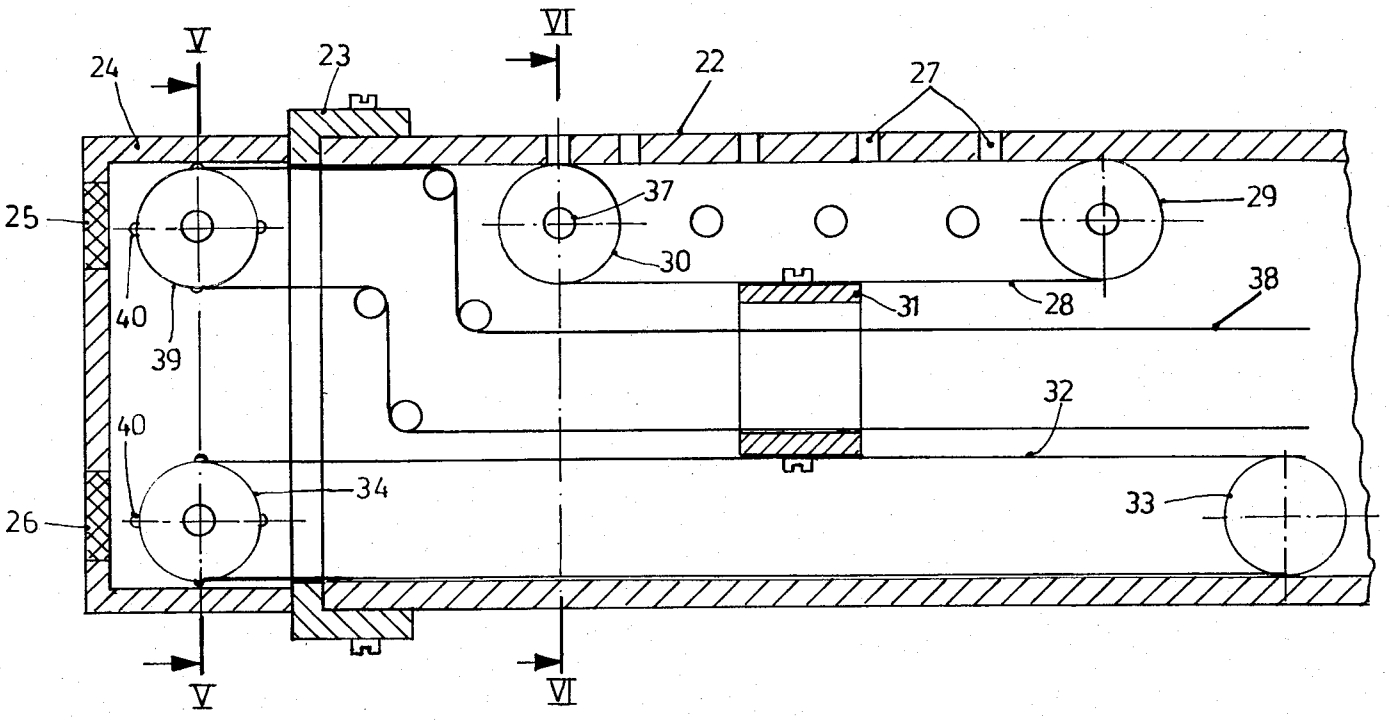
FIG. 4 is a fragmentary axial section of another embodiment of an air-equipped turning bar.
Figure 6:
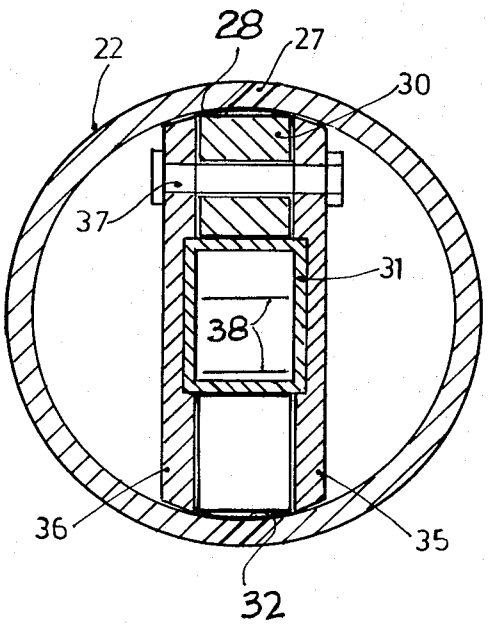
FIG. 6 is a cross section taken along lines VI—VI of FIG. 4.
Figure 5:
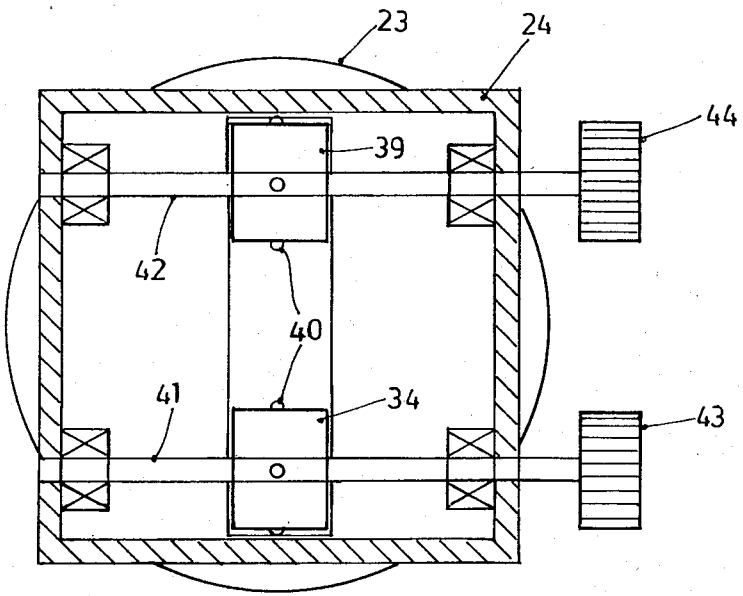
FIG. 5 is a cross section along line V—V of FIG. 4.

Embodiment of FIGS. 4–6

The tube 22 is closed off at both ends in a suitable manner, for example by end caps 23, best seen in FIGS. 4 and 5. A U-shaped housing 24 is connected to the cap 23-see FIG. 4-which is formed with two observation windows 25, 26, respectively, for example made of Plexiglas or the like.

A group of holes 27 is formed in a row at the upper side of the tube 22. A similar group of holes may be located at the lower side of the tube, not shown, if desired. A flexible, endless tape or ribbon 28 having the slit 90-see FIG. 3-is positioned beneath the holes 27. The tape 28 is guided in its endless path by two deflection rollers 29, 30. The lower run is coupled to a follower element 31. The tape 28 directly engages the inner wall of the tube 22 and is pressed thereagainst by the excess air pressure within the interior of tube 22 in those portions where the slit 90 is absent.

A second tape 32, guided over deflection rollers 33, 34, is located at the lower side of the tube. It, likewise, may be formed with a longitudinal slit 90 if the lower portion of the tube has air exit holes formed therein.

Preferably, bolts are used for the bearings for the respective deflection rollers, bolt 37 (FIG. 6) retaining the deflection roller 30 in position between two side walls 35, 36 fitted within the interior of the tube 22. The side walls are formed with facing, centrally positioned abutment surfaces or reliefs to guide the follower 31 therein-see FIG. 6. Other arrangements such as those shown in FIG. 2 may be used.

The flexible ribbons or bands are moved by positioning elements located in the housing portion 24 by, respectively, shifting the ribbons or tapes 28, 32, 38 directly. A deflection roller 34 is located in the housing 24 and coupled to an adjustment knob 43. Tape or band 32, guided above roller 34, is coupled to the follower 31. The lower run of the upper tape 28 is coupled to the follower 31 so that, upon rotation of the deflection roller 34, tape 32 as well as tape 28 will be shifted axially within the tube 22. The slits 90 in the tapes or ribbons or bands 28, 32 thus can selectively expose or cover the respective holes 27, or similar holes provided at the lower diametrical position of the tube 22.

Tapes or ribbons or bands 28, 32 are located at the left side of the turning bar formed by the tube 22. Tapes which are positioned at the right side thereof-not shown in the drawing-can be shifted by guiding an additional tape, as shown in FIG. 4 tape 38, longitudinally of the tube 22. The tape 38 is guided about a further deflection roller 39 located in the housing 24. This permits adjustment of air flow at both ends of the turning bar from one side only. To insure precise and reliable shifting of the tapes 32, 38, deflection rollers 34 and 39 are formed with engagement pins 40 which engage in two holes formed in the ribbons or tapes 32, 38, for example in the form of transport projections used with photographic film. The holes, of course, are located only in those regions of the tapes 32, 38 which are to be looped about the rollers 34, so that perforated portions will not be placed beneath the holes 27. Any suitable stop arrangements can be used to prevent excessive rotation of the respective deflection rollers 34, 39.

The deflection rollers 34, 39 are located on shafts 41, 42-see FIG. 5-and retained in suitable bearings fitted in housing 24. The right portion of the respective shafts 41, 42 extends from the housing 24 and has an adjustment knob 43, 44 located thereon, for manual rotation of the deflection rollers 34, 39, and thus shifting of the tapes 32, 38. The deflection rollers 34, 39 and the region of the tapes 32, 38 deflected thereby can be indicated by suitable scales or markers, and the tapes themselves can be formed with scales or markers which can be observed through the respective windows 25, 26. This substantially facilitates precise adjustment of the respective tapes or ribbons with respect to the openings 27 in the tube 22.

The tape 38 at the right side of the tube 22 can be guided by suitable deflection rollers similar to rollers 29, 30 and carry the slit directly; otherwise, it can be coupled to a follower similar to follower 31 for operation of a tape system 28, 32, as shown in FIG. 4.

Various changes and modifications may be made, and features described in connection with any one of the embodiments may be used with any of the others, within the scope of the inventive concept.

We claim:

1. Air-flow equipped turning bar for changing the path of a web, particularly of a web of printed material, having a tubular, hollow structure (1, 22) connected to a source of air under pressure above atmospheric to subject the interior thereof to overpressure;

a plurality of air exit holes (4, 27) located in at least one axial row along the circumference of the hollow structure;

and means for closing off selected ones of said holes, comprising, in accordance with the invention, a flexible ribbon or tape (5, 5', 28, 32, 38) located in the tubular structure close to the wall of the tubular structure through which the holes extend, said ribbon or tape, extending axially within the hollow tubular structure and being formed with a longitudinal slit (90) shorter than the length of the tape;

and positioning means (15, 13, 14, 16, 17, 18, 31, 34, 39, 40, 43, 44) coupled to the ribbon or tape axially moving the ribbon or tape, and for selectively positioning under selected ones of said holes (4, 4', 27) and slit (90) or a solid portion of the ribbon or tape, to permit, selectively, escape of pressurized air from the hollow interior of the tubular structure through the slit and the holes, or blocking of the holes by a solid portion of the ribbon or tape by engagement of the ribbon or tape against portions of the tubular structure surrounding the holes under force of the overpressure in the interior of the tubular structure, to seal the ribbon or tape against the interior walls of the tubular structure.

2. Turning bar according to claim 1, wherein the ribbon or tape is an endless tape;

and two deflection rollers (6, 7, 29, 30, 33, 34) are provided guiding the endless tape within the tubular hollow structure.

3. Turning bar according to claim 2, wherein the length of the slit (90) is approximately half the length of the ribbon or tape.

4. Turning bar according to claim 2, further including a rotatable spindle (13);

and a coupling element (14, 15) coupled to the tape and the spindle for moving the tape and hence the slit therein longitudinally of the tubular structure.

5. Turning bar according to claim 2, further including a pair of parallel side plates (10, 11, 35, 36) located within the tubular structure and extending essentially diametrically thereof, the deflection rollers being secured between said plates;

and an apertured guide rail or elongated plate (12) secured to said pair of side plates and having an outer shape fitting against the interior of said tubular structure, the rail or plate (12) being formed with air exit holes (4*a*, 4*a'*) matching the holes (4) in the tubular structure, the tape being guided by said deflection rollers within said plate or rail and pressed against the openings thereof by the overpressure within the interior of the tubular structure.

6. Turning bar according to claim 5, wherein two rows of air exit openings (4, 4') are provided, located at diametrically opposite positions in the tubular structure;

wherein two endless bands or ribbons are located within the tubular structure, mirror-image positioned;

and said further endless tape or ribbon (5') is an endless ribbon guided about two deflection rollers (6', 7') located between said side walls (10, 11).

7. Turning bar according to claim 6, wherein the two endless tapes or ribbons are axially shiftable with respect to each other.

8. Turning bar according to claim 1, wherein two rows of air exit openings (4, 4') are provided, located at diametrically opposite positions in the tubular structure;

and wherein two endless bands or ribbons are located within the tubular structure, mirror-image positioned.

9. Turning bar according to claim 1, wherein an end cap structure (23, 24) is provided, secured to an end portion of the tubular structure and closing off the end portion;

a deflection roller (34) is provided, the tape or ribbon being looped around said deflection roller;

said deflection roller being positioned within the end cap structure and including manually operable positioning means (43) coupled to the deflection roller.

10. Turning bar according to claim 9, wherein the tape or ribbon is an endless tape or ribbon, and a second deflection roller (33) is located and secured within the interior of the hollow tubular structure.

11. Turning bar according to claim 10, wherein two diametrically oppositely positioned tapes or ribbons (28, 32) are provided;

a coupling element (31) is provided, coupling said tapes or ribbons together to move both said tapes or ribbons by shifting one of them by means of said manually accessible positioning element (43).

12. Turning bar according to claim 11, further comprising approximately diametrically extending positioning plate means (35, 36) located within the tubular structure (22);

and wherein the deflection rollers within the tubular structure are secured to said positioning means.

13. Turning bar according to claim 11, wherein the follower comprises a hollow structure;

a third tape (38) is guided through the interior of said hollow structure and an additional deflection roller (39) is located within the end cap structure.

14. Turning bar according to claim 10, wherein the deflection roller is formed with radially extending projections;

and the tape is formed with matching notches or openings to provide an interengaging projection-and-recess connection between the deflection roller and the tape and insure positive movement of the tape or ribbon upon operation of the manually operable positioning element (43).

15. Turning bar according to claim 10, further comprising transparent portions (25, 26) located in the end cap structure opposite the deflection roller to permit visual observation of the positioning of the tape or ribbon thereby.

* * * * *

UNITED STATES PATENT AND TRADEMARK OFFICE

CERTIFICATE OF CORRECTION

PATENT NO. : 4,492,328

DATED : January 8, 1985

INVENTOR(S) : Wilhelm MÜNNICH et al

It is certified that error appears in the above-identified patent and that said Letters Patent is hereby corrected as shown below:

Column 5, line 11, change "and" to -- said--

Signed and Sealed this

*Third* Day of *September 1985*

[SEAL]

*Attest:*

DONALD J. QUIGG

*Attesting Officer* *Acting Commissioner of Patents and Trademarks - Designate*